US009744736B2

(12) United States Patent
De Weldige et al.

(10) Patent No.: US 9,744,736 B2
(45) Date of Patent: Aug. 29, 2017

(54) PRESS ROLL

(71) Applicant: MASCHINENFABRIK Koeppern Gmbh & Co.KG, Hattingen (DE)

(72) Inventors: Eggert De Weldige, Velbert Langenberg (DE); Kai-Uwe Habermann, Muelheim (DE); Axel Hoefter, Meppen (DE); Andreas Thierfeld, Dortmund (DE)

(73) Assignee: MASCHINEFABRIK KOEPPERN GMBH & CO. KG, Hattingen (DE)

( * ) Notice: Subject to any disclaimer, the term of this patent is extended or adjusted under 35 U.S.C. 154(b) by 0 days.

(21) Appl. No.: 14/767,529

(22) PCT Filed: Mar. 17, 2014

(86) PCT No.: PCT/EP2014/055330
§ 371 (c)(1),
(2) Date: Aug. 12, 2015

(87) PCT Pub. No.: WO2014/170076
PCT Pub. Date: Oct. 23, 2014

(65) Prior Publication Data

US 2016/0075097 A1 Mar. 17, 2016

(30) Foreign Application Priority Data

Apr. 17, 2013 (DE) ..... 10 2013 103 880

(51) Int. Cl.
*B30B 3/00* (2006.01)
*B30B 11/16* (2006.01)
*B02C 4/30* (2006.01)

(52) U.S. Cl.
CPC ..... *B30B 3/005* (2013.01); *B02C 4/30* (2013.01); *B30B 11/165* (2013.01)

(58) Field of Classification Search
CPC ..... B30B 11/165; B30B 11/16; B30B 3/005; B02C 4/30; B02C 4/305
(Continued)

(56) References Cited

U.S. PATENT DOCUMENTS 661,617 A * 11/1900 McCanna ..... B02C 2/10 241/294
2,294,098 A * 8/1942 Stromer ..... B02C 4/30 241/294
(Continued)

FOREIGN PATENT DOCUMENTS

DE 2536668 A 3/1977
DE 4344206 A 6/1995
DE 19910265 A 9/2000

OTHER PUBLICATIONS

English Translation of DE 4344206 A1.*

*Primary Examiner* — Jason L Vaughan
(74) *Attorney, Agent, or Firm* — Andrew Wilford

(57) ABSTRACT

The invention relates to a press roller for a roller press, in particular for briquetting, compacting or grinding granular material, having a roller core (1) and a roller sleeve fastened to the exterior of the roller core (1), said sleeve being composed of a plurality of segments (2), distributed over the circumference, with mutually facing lateral faces (3). The segments (2) have clamping shoulders (5) which extend around the front faces and have first clamping surfaces (8). The segments (2) are releasably fastened at each front face to the roller core (1) by means of at least one fastening ring (6), said fastening ring fitting over the clamping shoulders (5) of the segments (2). The front faces (12) and/or clamping shoulders (5) of the segments (2), in the front face edge regions associated with the lateral faces (3), have outer material reinforcements (13) which protrude outwardly relative to the first clamping surface (8) in the radial direction
(Continued)

and/or relative to the front face (12) in the axial direction and define, together with the clamping surfaces (8), pocket-type recesses (14) in between them in the circumferential direction, second clamping surfaces (9) of the fastening ring (6) resting against said pocket-type recesses.

9 Claims, 3 Drawing Sheets

(58) Field of Classification Search
USPC ..... 492/30, 31, 33, 34, 35, 36, 37; 493/38
See application file for complete search history.

(56) References Cited

U.S. PATENT DOCUMENTS 2,798,676 A * 7/1957 Heer ..... B02C 4/30 228/140
3,077,634 A * 2/1963 Komarek ..... B30B 11/165 100/155 R
3,090,105 A * 5/1963 Gibbar ..... B02C 4/305 241/294
3,873,259 A * 3/1975 Kennedy ..... B30B 15/34 425/237
3,907,486 A * 9/1975 Kennedy ..... B30B 15/34 425/237
3,938,930 A * 2/1976 Lauterbach ..... B30B 11/165 425/194
3,969,062 A 7/1976 Komarek
3,989,441 A * 11/1976 Lauterbach ..... B30B 11/165 29/724
4,034,461 A * 7/1977 Lauterbach ..... B30B 11/165 29/423
4,097,215 A * 6/1978 Komarek ..... B30B 11/165 425/237
4,123,971 A 11/1978 Bergendahl
4,337,023 A * 6/1982 Koppern ..... B30B 11/165 425/237
5,000,392 A * 3/1991 Kästingschäfer ..... B02C 4/305 241/294
5,253,816 A * 10/1993 Kastingschafer ..... B02C 4/30 100/176
5,755,033 A * 5/1998 Gunter ..... B02C 4/305 29/895.3
2014/0158801 A1 * 6/2014 Euculano ..... B02C 4/305 241/294

* cited by examiner

PRESS ROLL

CROSS REFERENCE TO RELATED APPLICATIONS

This application is the US-national stage of PCT application PCT/EP2014/055330 filed 17 Mar. 2014 and claiming the priority of German patent application 102013103880.8 itself filed 17 Apr. 2013.

FIELD OF THE INVENTION

The invention relates to a press roller for a roller press, particularly for briquetting, compacting or grinding granular material.

BACKGROUND OF THE INVENTION

Such a roller typically has a roller core and a roller sleeve fastened to the periphery of the roller core that is composed of several segments distributed over the periphery with mutually facing side faces, the segments having clamping shoulders on their end faces with first clamping faces and the segments being detachably fastened on the end faces by at least one respective fastening ring to the roller core that engages over the clamping shoulders of the segments. Such a roller is preferably a press roller for a roller press for hot-briquetting or hot-compacting, for example hot-briquetting or hot-compacting of directly reduced iron (DRI). Relative to the invention, granular material also refers to dusty or powdery material. The (bilateral) side faces are surfaces that delimit the respective segment angularly. A side face of a segment consequently confronts a side face of a segment that is adjacent or follows angularly. The side faces are aligned so as to extend axially, and they are secured in place axially and radially of the roller axis and delimited by the inner periphery and the outer periphery of the respective segment.

A roller press generally has two press rollers rotating in opposite directions. During briquetting or compacting, the granular bulk material is compacted between the rollers. For this purpose, the roller sleeve, which is composed of the segments, is equipped with pressing tools that can have mold cavities for the briquetting or compacting. However, the invention also includes press rollers with segments that are provided with another wear-protection layer, for example for the size-reduction of material. Particularly during hot-briquetting or hot-compacting, the press rollers are exposed to high temperatures from the material to be processed, so that the segments themselves also reach high temperatures. This applies, for example, to the processing of reduced iron ores or sponge iron, in which the temperatures can reach up to 900° C. At high temperatures, the segments and their pressing tools are generally subject to wear. In order to limit the wear, such press rollers and their casings are generally cooled, for example by water. It has long since been known to integrate cooling channels into the clamping rings of the rollers.

Since the (tool) segments are generally subject to wear, they are detachably and thus exchangeably fastened to the roller core. The fastening is done with by bilateral fastening rings that are also referred to as locking rings or clamping rings and that engage over the bilateral clamping shoulders of the segments. High demands are placed on the stability of these segments in practice, since they are subjected to high loads.

A roller press for the hot-compacting and hot-briquetting of bulk materials with press rollers with segments is known, for example, from DE 25 36 670 (U.S. Pat. No. 4,123,971). The segments are provided with lugs or shoulders on which fasteners engage that secure the segments to the roller core. In this previously known design, clamping brackets supported on the roller core are provided as fasteners that are pressed against the segment by a tension bolt. Alternatively, cooled shrink rings, radially arranged screws or the like are also proposed as fasteners.

The fastening of the segments by fastening rings or clamping rings that engage over the clamping shoulders of the segments is also known in practice. The clamping shoulders generally have the same cross section over the entire peripheral region of the segment. The clamping bolts are provided at the region of the side faces between two mutually adjacent segments. For this purpose, suitable grooves are worked into the side faces to receive the clamping bolts. The known designs have proven themselves in principle, but they can be further developed with respect to their stability and durability. This is where the invention comes in.

OBJECT OF THE INVENTION

It is the object of the invention to provide a press roller for a roller press of the type described above that is characterized by a high level of stability and durability of the segments while having a simple construction and being easy to assemble, so that long service lives for the segments are ensured.

SUMMARY OF THE INVENTION

To achieve this object, the invention teaches, with a generic press roller for a roller press of the type described above that the segments have on their end faces and/or clamping shoulders on the end faces at the side faces outer material reinforcements that project radially outward relative to the first clamping face and/or axially relative to the end face and form pockets angularly therebetween with the first clamping faces against which second clamping faces of the fastening ring rest. It is advantageous if the fastening ring has several clamping projections distributed over the periphery, associated with segments that have the first clamping faces, for example, and extend over only a portion of the periphery of a segment and engage in the pockets of the segments. Preferably, each segment has a pocket, and the clamping ring has a plurality of clamping projections, a clamping projection being associated with each segment. However, it also lies within the scope of the invention for a segment to have several pockets and/or for several clamping projections to be associated with a segment, or for several clamping projections to be associated with a pocket.

The invention proceeds from the insight that the stability and thus the service life of the segments can be increased if the segments are equipped in a targeted manner with (outer) material reinforcements. This consideration stems from the fact that the fastening ring does not necessarily have to be braced with the segments over the entire periphery, so that a locally limited bracing by the described clamping projections, for example, is sufficient. For instance, it is possible to equip the segments with additional material reinforcements and consequently thickenings, since no clamping faces need to be made available in these regions for bracing. In this way, the stability of the segments can be improved substantially in especially critical regions, and the service life is increased. As a result, the clamping ring has the shape of a crown ring with crown-like projections that project preferably inwardly from the clamping ring radially (i.e. toward the roller axis) and also project inwardly from the clamping ring or its base ring in an axially extending direction (i.e. toward the segment). Such an embodiment provides an outstanding possibility for achieving the previously described material reinforcements that do not impair tightening and that increase the stability of the segments.

Especially preferably, the fastening of the fastening ring in terms of bracing is achieved by means of axially extending clamping bolts, that is, the fastening ring is braced against the segments by axially extending clamping bolts. In this regard, that the first clamping faces and/or the second clamping faces can be oriented at an acute angle to the roller axis in order to produce a radial clamping force during tightening of the axially extending clamping bolts. The clamping shoulders thus have, in a basically known manner, first clamping faces, and the clamping ring has, also in a known manner, second clamping faces; that is, the clamping faces of the clamping ring press on the clamping faces of the clamping shoulders during assembly such that the segments are braced on the roller core. As a result of the angled faces, the clamping forces applied axially are thus intensified into radial forces, thus ensuring the trouble-free fixation of the segments on the roller core. In addition to this non-positive connection, however, the segments are also held in a positive manner on the roller core. For this purpose, the segments have on their inner periphery and the roller core has on its outer surface suitable positive-fitting elements (projections and recesses), thus implementing, for example, a tongue-and-groove connection between segments and roller core. According to another proposal of the invention, the segments each have at least one axially extending throughgoing hole for the clamping bolts that is arranged between the two side faces of the segment relative to the extension angularly, for example in the center between the two side faces. In this regard, the invention proceeds from the insight that the stability and thus the service life of the segments can be further increased if the clamping bolts with which the two fastening rings are braced against each other under interposition of the segments are not arranged in the region of the side faces and consequently between two successive segments, but rather if a throughgoing hole for the clamping bolt is integrated into the segment, for example in the center between the two side faces, particularly relative to the angular extension. The result of these optional measures is that there is no need to form any axially extending grooves, projections or the like in the side faces of the segments that receive a clamping bolt in the assembled state. Through these measures, possible weak points of the segments are avoided particularly in the region of the side faces, thus further increasing the stability of the segments. The introduction of the axially extending throughgoing holes as a bore, for example, can be achieved using simple technical means without impairing the stability of the segment. Likewise, a simple bracing is possible in this way. Alternatively, however, other embodiments are also included in which the clamping bolts are arranged in a conventional manner between the segments.

The above-described material reinforcements and essential to the invention are preferably on both sides of the throughgoing hole (for the clamping bolt), so that the throughgoing hole is preferably arranged between the material reinforcements in the region of the pocket. The described clamping ring thus acts with its clamping projections preferably only in a central region on the segments, the clamping bolts also being in this central region.

The fastening ring (clamping ring) preferably has a clamping collar with the second clamping faces engaging over the clamping shoulder of the segments, the second clamping faces being braced against complementary first clamping faces of the clamping shoulders of the segments. The clamping projections are on the clamping collar, and they preferably project radially inward from the clamping collar and axially inwardly from the clamping ring or a base ring of the clamping ring.

As described, the fastening rings are preferably braced by clamping bolts. Alternatively, however, the embodiment according to the invention with the described material reinforcements and the pockets of the segments arranged therebetween can also be achieved with fastening rings that are fixed by shrinking in the manner of a thermal cross brace. Consequently, the invention also includes such embodiments in which the fastening ring is shrunk onto the segments or their clamping shoulders.

Another proposal of the invention relates to the formation of the side faces of the segment. It was already explained that grooves or the like in the region of the side faces for guiding the clamping bolts can be omitted. Nevertheless, a certain contour of the side faces can be useful, particularly in order to enlarge the arc length of the contact surface between segment and core, thus reducing the danger of tilting under asymmetrical loads. Accordingly, one side face of the segment has a nose, for example, and the other side face of the segment has a complementary pocket, the nose of a segment engaging similarly to a tongue-and-groove connection into a corresponding pocket of the adjacent or following segment. In this way, an extended footprint of the segments on the core is achieved. This embodiment, which is similar to a tongue-and-groove connection, relates substantially to the central region of the side face. The side faces are consequently flat in the side face edge regions associated with the ends, that is, on both sides of the nose/pocket over the entire radial thickness of the segment and radially above the noses/pockets over the entire axial thickness of the segment and are consequently stepless. Through such a substantially level/stepless embodiment of the edge regions of the side faces, weak points are avoided, thus achieving an especially stable construction.

The object of the invention is also a roller press with two press rollers of the described type. The press rollers essential to the invention are therefore protected especially preferably in combination within a roller press. Such a roller press can preferably be designed for the briquetting and/or compacting of granular material, particularly for hot briquetting or compacting.

BRIEF DESCRIPTION OF THE DRAWING

The invention is described in further detail below with reference a figure illustrating only one embodiment.

SPECIFIC DESCRIPTION OF THE INVENTION

Figure 1:
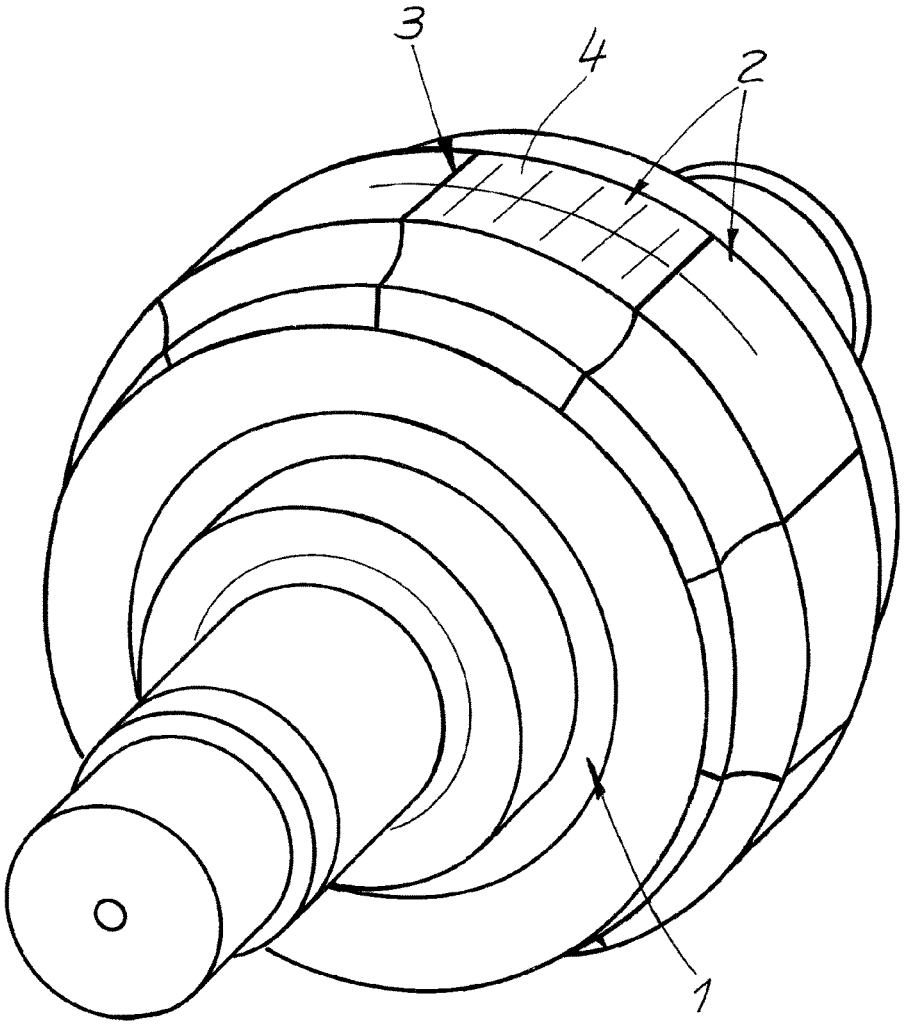
FIG. 1 is a schematic simplified perspective view of a press roller.

FIG. 1 shows a press roller for a roller press, particularly for briquetting or compacting and especially preferably for hot-briquetting or hot-compacting granular material. Basically, such a press roller consists of a roller core 1 and a roller sleeve fastened to the roller core 1 that is formed by several segments 2 distributed over the periphery, these segments 2 having axially extending side faces 3. The segments 2 each have a profiled outer surface; here embodiment, they have mold cavities 4 for briquetting or compacting. These shaping tools/mold cavities 4 are unitarily formed in each segment 2. Each segment 2 has a clamping shoulder 5 on each end.

Figure 2:
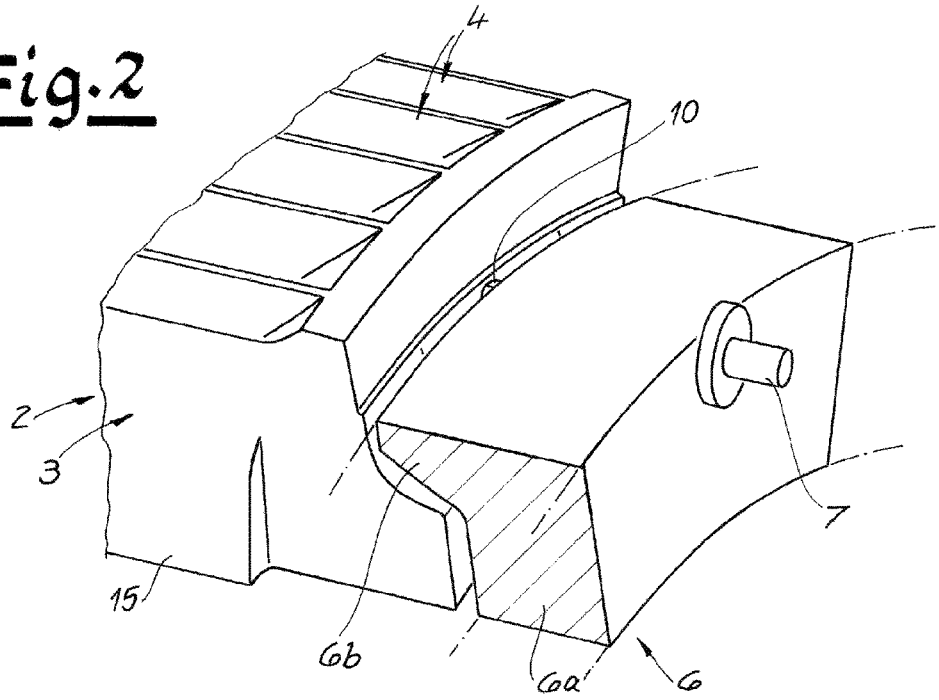
FIG. 2 is a perspective section of the roller according to FIG. 1.
Figure 3:
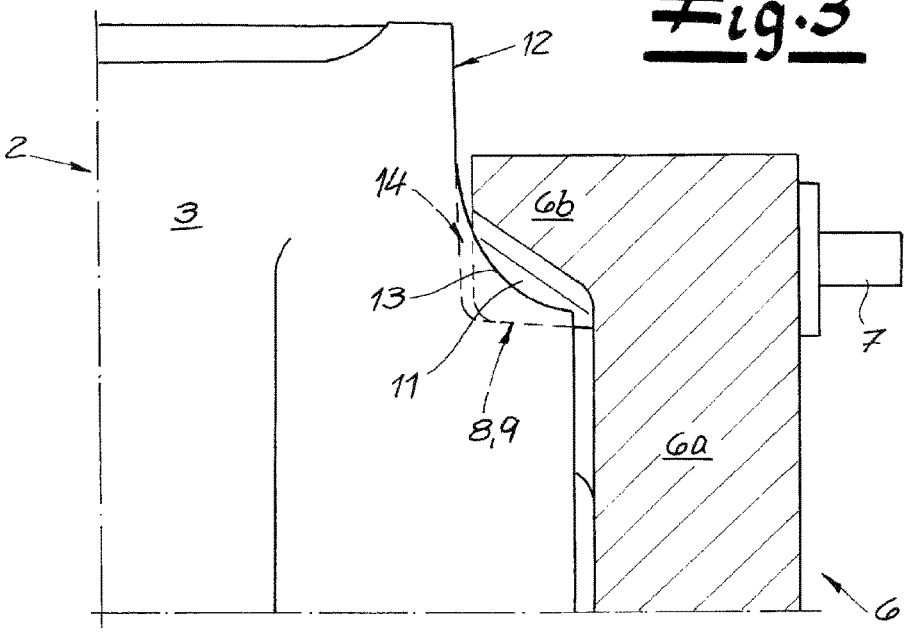
FIG. 3 is a side view of the roller as in FIG. 2.
Figure 4:
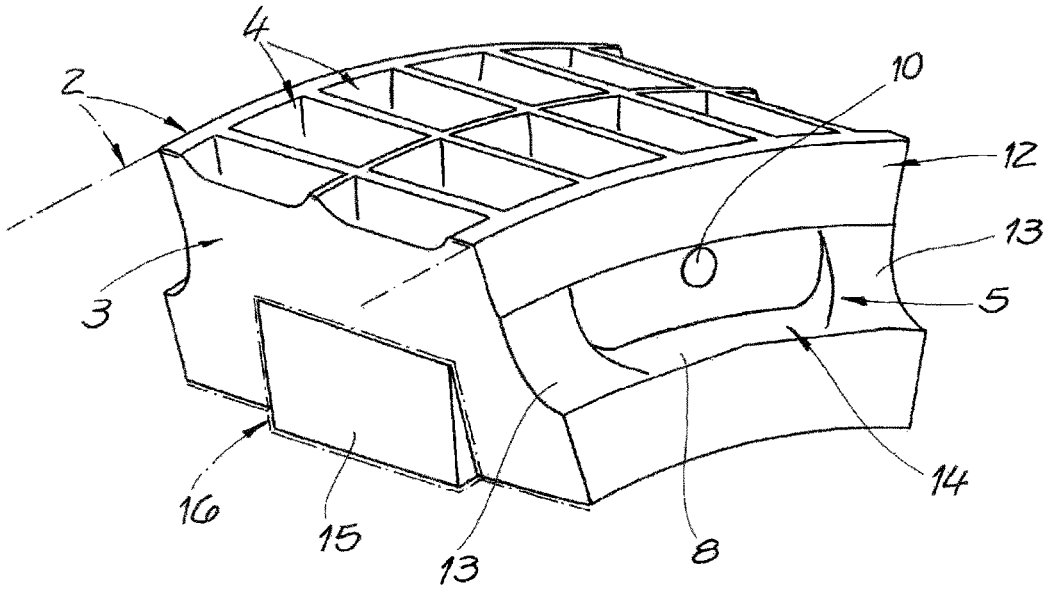
FIG. 4 is a perspective view of the press roller according to FIG. 1.
Figure 5:
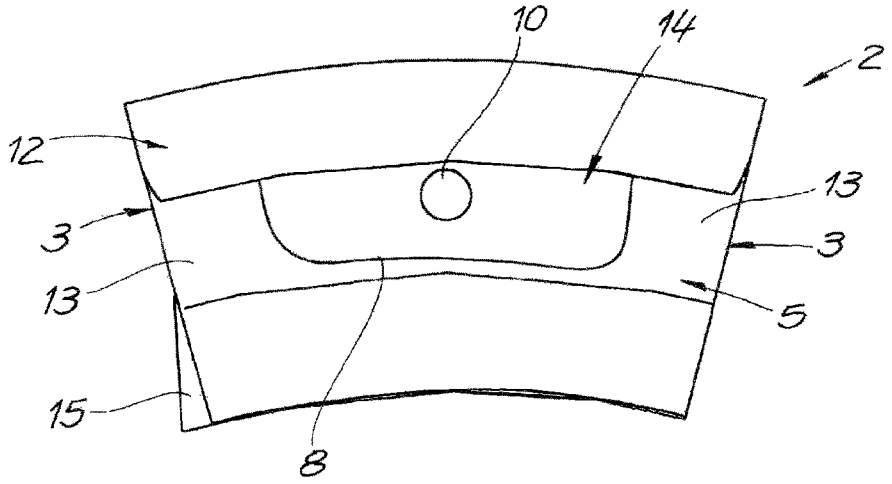
FIG. 5 is a front view of the roller as in FIG. 4.

The fastening of the segments 2 on the roller core 1 is done with two fastening rings 6 that are also referred to as clamping collars or clamping rings. They are shown in FIG. 2. The two fastening rings 6 are placed at both ends, so that they engage over the clamping shoulders 5 of the segments 2. The two fastening rings 6 are secured by axially extending clamping bolts 7 against the ends of the segments 2 they axially flank. The clamping shoulders 5 have first clamping faces 8, and the clamping ring 6 has second clamping faces 9. In order to enable the generation of radial force during when the axially extending clamping bolts 7 are tightened, the first clamping face 8 and the second clamping face 9 extend at an acute angle to the roller axis. The axial or axially extending clamping force applied by the clamping bolts 7 is consequently amplified and converted into a radially inward clamping force, thus ensuring solid fastening of the segments 2 on the roller core 1. A positive connection can also be provided between the segments 2 and the roller core 1, for example by having positively interfitting formations of the segments 2 on the inner periphery (or lower side) engage in complementary formations of the roller core 1 on the outer surface (and/or vice versa). In any case, special importance is given in the illustrated embodiment to tightening of the segments 2 by the fastening ring 6 and the clamping bolt 7. Each fastening ring 6 is profiled in cross section. It has a circumferential base 6*a* on the one hand and a circumferential clamping collar 6*b* on the other hand, so that it of substantially L-shaped cross section. This circumferential clamping collar 6*b* engages with the second clamping faces 9 over the clamping shoulders 5 of the segments 2, so that the second clamping faces 9 of the clamping ring 6 are pressed radially inward against the first clamping faces 8 of the clamping shoulders 5.

The segments 2 each have an axially extending and throughgoing hole 10 through which the clamping bolts 7 extend. These axially throughgoing holes 10 are each angularly between the two side faces 3 of a segment 2. In this embodiment, the hole 10 of a segment 2 is angularly centered between the two side faces 3 of the respective segment. The throughgoing holes 10 are as bores, and they extend through the entire axial length of the respective segments 2, so that the clamping bolts engage completely through the segments. In this way, the two fastening rings 6 can be braced on both sides of the segments with each other under interposition of the segments 2.

Here, the clamping ring 6 does not have a uniform cross section over the entire periphery, but rather the clamping ring 6 has locally limited clamping projections 11. The clamping ring 6 thus has several clamping projections 11, each associated with a segment 2, distributed over the periphery, each of these clamping projections 11 forms a respective one of the second clamping faces 9. The clamping projections 11 thus extend over only a portion of the arc length of a segment 2, so that the force input from the clamping ring 6 does not occur over the full periphery (or over the entire surface), but only in a locally limited manner in the region of the clamping projections 11.

The segments 2 have outer material reinforcements 13 on their end faces 12 and their clamping shoulders 5 (or in the transition region between end face 12 and clamping shoulder 5). These material reinforcements 13 project outwardly relative to the first clamping face 8 radially and relative to the end face 12 axially, so that a pocket is respectively provided angularly between two material reinforcements 13 of a segment 2. The first clamping faces 8 of the segments 2 fit in these pockets 14, i.e. the clamping ring 6 engages with its locally limited clamping projections 11 into these pockets 14 of the segments. The material reinforcements 13 that are on in the front end face of the segments 2 at with the side faces and thus do not impair the trouble-free bracing. They provide an increase in stability in regions of the segments that are subjected to especially high loads. The clamping ring 6 is thus embodied a sort of crown. The second clamping face 9 are each on a radial inner side of a rap one of the locally limited clamping projections 11, this second clamping face 9 as well as the first clamping face 8 of the segments 2 is extending at an acute angle in the pockets 14 relative to the roller axis.

Moreover, the drawing shows that two segments angularly one after the other engage in each other. For this purpose, one side face 3 of a segment 2 has an angularly projecting nose 15 while the opposite side face 3 of the same segment 2 has a corresponding angularly open pocket 16 so that the nose 16 of a segment engages in a manner similar to a tongue-and-groove connection into the corresponding pocket 16 of the angularly adjacent segment. Apart from these elements (noses 15/pockets 16), the side faces 3 are flat or planar and thus stepless. In particular, profiling for the clamping bolts or clamping rods 7 can be omitted, since these clamping bolts are guided according to the invention through the central holes in the segment 2. In this way, the side faces 3, particularly at their edges at the ends, namely on both sides of the noses and pockets over the entire radial thickness of the segment and radially above the noses/pockets, can be planar and thus stepless over the entire axial thickness of the segment. Notches and projections are thus avoided, which contributes to an increase in the strength and durability of the individual segments.

In the figures, an embodiment is shown in which the fastening ring 6 is braced by clamping bolts 7 against the segments 2. However, the invention also includes embodiments in which the fastening ring is shrunk onto the segments or their clamping shoulders. This is not shown in the figures.

The invention claimed is:

1. A press roller for a roller press for briquetting, compacting or grinding granular material, the roller comprising:

a roller core defining and centered on an axis;

a roller sleeve secured to an outer surface of the roller core and formed by a plurality of angularly distributed segments with mutually angularly confronting side faces, the segments each having an axial end face and, projecting axially therefrom, an angularly extending clamping shoulder formed with a respective first clamping face, a fastening ring detachably securing the segments to the roller core, formed at each of the segments with a respective second clamping face, and engaging over the clamping shoulders of the segments with the second clamping faces bearing radially and axially on the first clamping faces of the segments, and two respective angularly spaced outer material reinforcements on each of the end faces of the segments adjacent the side faces, the material reinforcements projecting radially outward from the respective first clamping faces and axially from the respective end faces, the segments each being formed in the respective shoulder with a respective pocket angularly between the respective reinforcements and the respective side faces and formed with the first clamping faces of the respective shoulder.

2. The press roller defined in claim 1, wherein the fastening ring is shrunk onto the segments or their clamping shoulders.

3. The press roller defined in claim 1, further comprising: axially extending clamping bolts pressing the fastening ring against the segments.

4. The press roller defined in claim 1, wherein the first clamping faces or the second clamping faces are aligned at an acute angle to a roller axis in order to generate a radial clamping force, during tightening of the axially extending clamping bolts or during shrinking.

5. The press roller defined in claim 1, wherein the fastening ring has several clamping projections each associated with a respective one of the segments, distributed over the periphery having the first clamping faces, and extending over only a portion of the arc length of each respective segment and engaging in the pockets of the segments.

6. The press roller defined in claim 1, wherein the segments each have at least one axially extending throughgoing hole for the clamping bolts that is centered angularly between the two side faces.

7. The press roller defined in claim 6, wherein the material reinforcements are provided on both sides of the throughgoing hole, so that the throughgoing hole is between the material reinforcements and in the region of the pocket.

8. The press roller defined in claim 1, wherein the fastening ring has an axially inwardly projecting clamping collar formed with radially inwardly directed clamping projections formed in turn with the second clamping faces and engaging radially into the pockets of the clamping shoulders of the segments to press the second clamping faces against the respective first clamping faces of the clamping shoulders of the segments.

9. The press roller defined in claim 8, wherein the clamping projections are on the clamping collar and project radially inward from the clamping collar and project axially inwardly from the fastening ring or a base of the fastening ring.

* * * * *